US009126744B2

(12) United States Patent
Peltz et al.

(10) Patent No.: US 9,126,744 B2
(45) Date of Patent: Sep. 8, 2015

(54) CONTAINER AND METHOD FOR CONTAINING AND/OR SUPPRESSING A FIRE

(75) Inventors: Jeffrey E. Peltz, Memphis, TN (US); Arthur J. Benjamin, Germantown, TN (US)

(73) Assignee: FEDERAL EXPRESS CORPORATION, Memphis, TN (US)

( * ) Notice: Subject to any disclaimer, the term of this patent is extended or adjusted under 35 U.S.C. 154(b) by 1887 days.

(21) Appl. No.: 11/887,121

(22) PCT Filed: Mar. 23, 2006

(86) PCT No.: PCT/US2006/010831

§ 371 (c)(1),
(2), (4) Date: Jun. 15, 2009

(87) PCT Pub. No.: WO2006/104904

PCT Pub. Date: Oct. 5, 2006

(65) Prior Publication Data

US 2009/0255694 A1 Oct. 15, 2009

Related U.S. Application Data

(60) Provisional application No. 60/664,940, filed on Mar. 25, 2005.

(51) Int. Cl.
*B65D 88/14* (2006.01)
*B65D 90/02* (2006.01)
(Continued)

(52) U.S. Cl.
CPC ..... *B65D 88/14* (2013.01); *B65D 90/021* (2013.01); *B65D 90/022* (2013.01); *B65D 90/22* (2013.01); *E05G 1/024* (2013.01)

(58) Field of Classification Search
CPC ..... B65D 90/021; B65D 90/022
USPC ..... 220/1.5, 1.6, 4.24, 23.88, 88.1, 16; 169/48; 252/606
See application file for complete search history.

(56) References Cited

U.S. PATENT DOCUMENTS 3,856,178 A * 12/1974 Norgaard ..... 220/23.83
4,025,485 A * 5/1977 Kodama et al. ..... 524/729
(Continued)

FOREIGN PATENT DOCUMENTS

CN 2287422 Y 8/1998
EP 0 269 357 A2 6/1988
(Continued)

OTHER PUBLICATIONS

First Office Action issued Jul. 19, 2011, in Japanese Patent App. No. 2008-503233, which is a counterpart to the present application.

*Primary Examiner* — Arthur O Hall
*Assistant Examiner* — Viet Le
(74) *Attorney, Agent, or Firm* — Finnegan, Henderson Farabow, Garrett & Dunner, L.L.P.

(57) ABSTRACT

A container for containing and/or suppressing a fire may include a floor, a roof, and at least one wall associating the floor and the roof. The at least one wall may define an opening configured to provide access to the interior of the container. The container may further include at least one panel configured to close the opening. At least one of the floor, the roof, the at least one wall, and the at least one panel may include an intumescent material substantially covering an interior surface thereof.

18 Claims, 3 Drawing Sheets

(51) Int. Cl.
*B65D 90/22* (2006.01)
*E05G 1/024* (2006.01)

(56) References Cited

U.S. PATENT DOCUMENTS 5,360,129 A 11/1994 Lee
5,532,292 A * 7/1996 Wainwright et al. ..... 523/179
5,601,201 A * 2/1997 Looker ..... 220/1.5
6,161,714 A * 12/2000 Matsuura et al. ..... 220/1.5
2003/0094885 A1* 5/2003 Cleveland et al. ..... 312/409

FOREIGN PATENT DOCUMENTS

GB 2 277 871 A 11/1994
JP 59-30738 2/1984
JP 62-165288 10/1987
JP 4-502744 5/1992

* cited by examiner

CONTAINER AND METHOD FOR CONTAINING AND/OR SUPPRESSING A FIRE

RELATED APPLICATION

This application claims the benefit of priority of U.S. Provisional Application No. 60/664,940, filed on Mar. 25, 2005, the disclosure of which is incorporated herein by reference.

FIELD OF THE INVENTION

The present invention relates to containers and methods for suppressing and/or containing a fire. In particular, the present invention relates to containers and methods for containing and/or suppressing a fire associated with objects located in the container.

BACKGROUND OF THE INVENTION

Objects may be stored and/or transported in containers, for example, to organize or improve the ease of handling the objects. For example, freight may be placed in containers for storage and/or later shipment via aircraft, trucks, boats, and/or trains. In the air freight industry, for example, freight may be transported in the bellies of passenger aircraft or in both the bellies and on main decks of freighter aircraft. Containers, generically referred to as Unit Load Devices (ULDs), may be used to contain freight for air transport. Over time, ULDs having differing sizes and shapes have been standardized and developed, both for belly and main deck application for use in various aircraft. Descriptions and specifications for ULDs may be found in documents, such as, for example, the National Aerospace Standard (NAS) 3610 and the International Air Transport Association (IATA) ULD Technical Manual.

Examples of freight placed in containers may include objects such as cardboards, woods, fabrics, packing materials, paper, and other carbon based materials, which are defined as Class A materials by the Federal Aviation Administration (FAA). Since such containers may be transported via aircraft and may be loaded into the belly or onto the main deck of an aircraft cabin, a flight crew of the aircraft may not have access to the containers, for example, once the aircraft is fully loaded and ready for flight. As a result, if a fire were to occur in a container located in the aircraft cabin, the flight crew might not have access to the container experiencing the fire, thereby preventing them from attempting to control or extinguish the fire with a hand-held fire extinguisher.

Such a fire may present serious risks, in particular, if the aircraft is airborne and a great distance from an airport suitable for making an emergency landing, such as, for example, when an aircraft is traveling over a large body of water. Such a fire may result in the loss of the flight crew and/or passengers and the aircraft.

Tests conducted by the FAA and the aviation industry have determined that a cargo fire associated with Class A materials, once ignited, may smolder and burn slowly in a container (e.g., a ULD) for an extended period of time, for example, as long as thirty minutes or more. But once the average temperature of the ULD reaches 200 degrees Fahrenheit (F.), a fire normally accelerates rapidly, often reaching 1,000 degrees F. in less than sixty seconds. Thereafter, temperatures resulting in burn-through or failure of the container walls and/or ceiling are frequently reached, and the conflagration may quickly spread to adjacent ULDs, possibly igniting them, as well.

Furthermore, some FAA-approved containers include Lexan® walls, which may pose a particularly serious problem. In particular, at very high temperatures, Lexan® will soften and may outgas, causing a flashover fire, which may greatly add to the spread of the fire. Aircraft container bases, on the other hand, are relatively thick for structural reasons, and burn-through of container bases is not considered likely. In addition, aircraft container bases may be formed from aluminum, which transfers heat well, and the aircraft containers are sometimes located on a conveyor system, including rollers or ball transfer units, which permits a cooling flow of air underneath the containers that may serve to carry heat away from the containers.

Various active fire suppression schemes for belly and main deck container fires have been implemented in the air cargo industry. Water misting and Halon® flooding, for example, are two representative examples of conventional technologies used to contain fires in aircraft cabins. Most, if not all, active suppression schemes, however, require the delivery of a suppressant agent to the container experiencing a fire. As a result, some such schemes are heavy and complex, which are not typically desirable characteristics for an aircraft fire suppression system.

As a result, there may be a desire to provide containers and methods for containing add/or suppressing a fire in a container.

The invention may seek to satisfy the above-mentioned desire. Although the present invention may obviate the above-mentioned desire, it should be understood that some aspects of the invention might not necessarily obviate it.

SUMMARY OF THE INVENTION

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a container for containing and/or suppressing a fire. The container may include a floor, a roof, and at least one wall associating the floor and the roof. The at least one wall may define an opening configured to provide access to the interior of the container. The container may further include at least one panel configured to close the opening. At least one of the floor, the roof, the at least one wall, and the at least one panel may include an intumescent material substantially covering an interior surface thereof.

A further aspect may relate to a system of containers for suppressing and/or containing a fire. The system may include a container including a floor, a roof, and at least one wall associating the floor and the roof. The at least one wall may define an opening configured to provide access to the interior of the container. The container may further include at least one panel configured to close the opening. The system may further include at least one relatively smaller container contained within the container. At least one of the container and the at least one relatively smaller container may include an interior surface substantially covered with an intumescent material.

In another aspect, a method for improving a container's fire containment an/or fire suppression capability may include providing a layer of intumescent material on at least one interior surface of the container.

Aside from the structural and procedural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

DESCRIPTION OF EXEMPLARY EMBODIMENTS

Figure 1A:
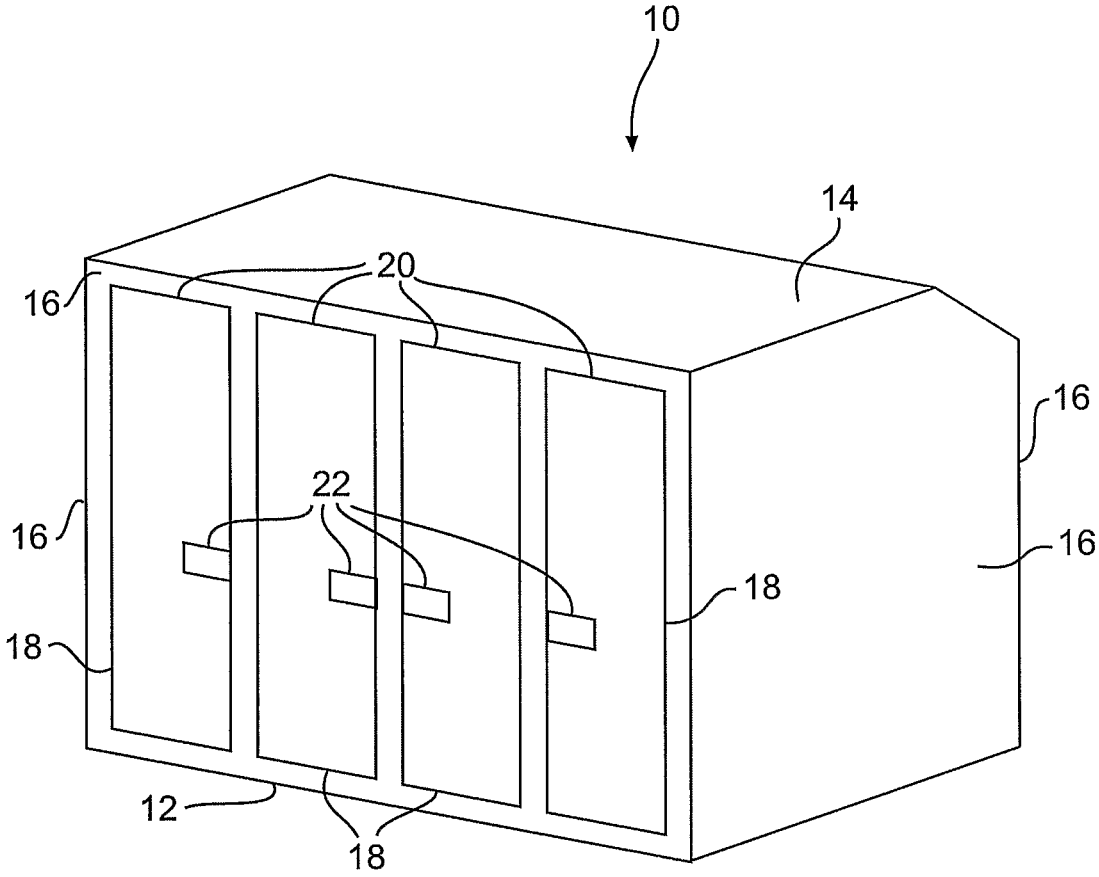
FIG. 1A is a schematic perspective view of an exemplary embodiment of a container for containing and/or suppressing a fire.

Reference will now be made in detail to a few exemplary embodiments of the invention. Wherever possible, the same reference numbers are used in the drawings and the description to refer to the same or like parts.

FIG. 1A schematically depicts an exemplary embodiment of a container 10 for containing and/or suppressing a fire. The container 10 may include a floor 12 and a roof 14 associated with one another via walls 16. One or more of the walls 16 may include one or more openings 18 configured to permit access to the interior of the container 10. The container 10 may further include one or more panels 20 (e.g., door(s)) configured to close the one or more openings 18. The panel(s) 20 may be formed of metal and/or fabric. According to some embodiments, the panel(s) 20 may be hingedly secured to a portion of the container 10 and/or may be configured to be removed from the container 10. The panel(s) 20 may include one or more latches 22 configured to secure the panel (s) 20 in the opening(s) 18.

The walls 16 of the container 10 may be formed from a variety and/or combination of materials. For example, one or more of the walls 16 may include aluminum (e.g., a sheet of aluminum) and/or various plastic or composite materials, such as, for example, Lexan®, fiberglass, Kevlar®, polypropylene, and/or honeycomb panels. The use of other materials is contemplated. The floor 12 may be formed of, for example, aluminum, such as, for example, a relatively thick (e.g., a thickness ranging from about 0.160 inch to about 0.190 inch) sheet of aircraft aluminum and/or of aluminum sheets sandwiching another material, such as, for example, a honeycomb material, to provide stiffness and/or structural strength. The panels) 20 of the container may be formed of metal and/or fabric (e.g., a high temperature-resistant fabric such as, for example, fiberglass cloth).

The interior of the container 10 may include a layer (e.g., a coating) of intumescent material. For example, interior surfaces of the floor 12, roof 14, walls 16, and/or panel(s) 20 may include a coating of intumescent material that at least partially covers the floor 12, roof 14, walls 16, and/or panel(s) 20. For example, as depicted in FIG. 1B, the roof 14, the walls 16, and/or the panel(s) 20 may include-a layer of aluminum or Lexan® 24, and the interior surfaces of the roof 14, the walls 16, and/or the panel(s) 20 may be coated with a layer of intumescent material 26.

Figure 1B:
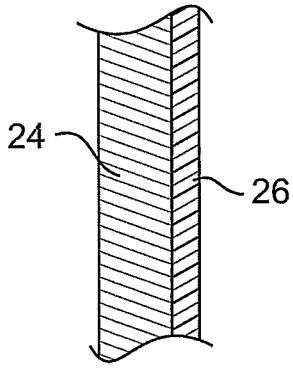
FIG. 1B is a schematic, partial cross-section view of a portion of the embodiment of FIG. 1A.

The intumescent material 26 schematically depicted in FIG. 1B may be supplied in, for example, liquid form and may be applied, for example, via brush, roller, and/or spray (e.g., like paint). According to some embodiments, the intumescent material 26 may include an acrylic chemistry and/or an epoxy chemistry (e.g., a latex, for example, a latex material marketed as PyroBlok® by Bradford Industries, Inc.). The use of other intumescent materials known to a person-having skill in the art is contemplated.

The intumescent material 26 may serve to at least assist with containment and/or suppression of a fire associated with objects in the container 10. For example, the intumescent material 26 may intumesce (or swell) when exposed to elevated temperatures and/or fire, and the intumescent material 26 may form a char layer, which includes a low coefficient of thermal conductivity, thereby reducing heat transfer into the coated surface. According to some embodiments of intumescent material 26, the intumescent material 26 may also form a thin refractory layer, which may serve to reflect heat back toward its source. According to some embodiments, intumescing may begin, for example, when the intumescent material 26 is heated to a temperature of approximately 400 degrees F.

For a test conducted on an LD-3 belly ULD-type container, including walls and a ceiling having interior surfaces coated with an epoxy-type intumescent material (i.e., PyroBlok®), a fire was ignited in the center of the container and the temperatures of the center of the container and the container walls were measured. The test showed that even when the center of the container reached a temperature well in excess of 1,200 degrees F., the wall temperatures typically measured about 230 degrees F. The wall temperatures did not rise to 451 degrees F., which is the auto-ignition temperature of paper. Further, during the test, a section of Lexan® wall coated with the intumescent material was placed in the container, and the Lexan® remained hard throughout the test despite the fire.

Figure 2A:
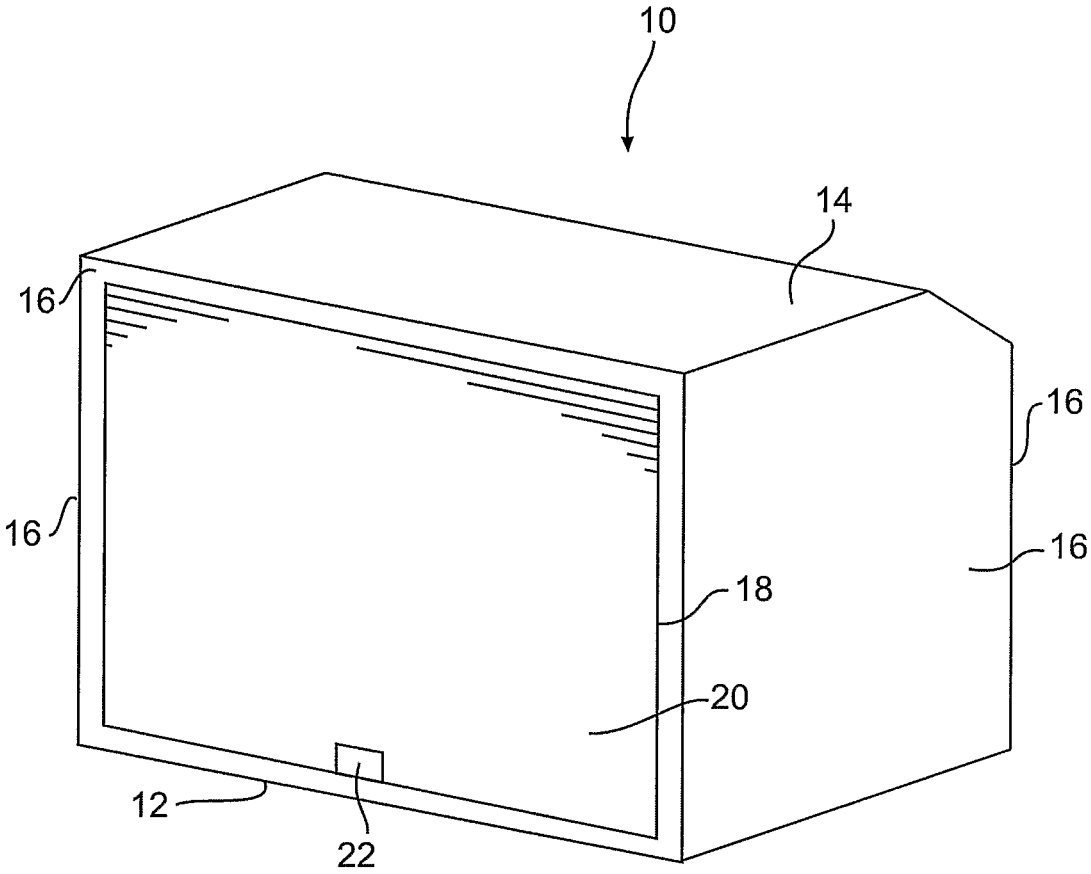
FIG. 2A is a schematic perspective view of another exemplary embodiment of a container for containing and/or suppressing a fire.

Referring to the exemplary embodiment of container 10 schematically depicted in FIG. 2A, the container 10 may include a floor 12 and a roof 14 associated with one another via walls 16. One or more of the walls 16 may include an opening 18 configured to permit access to the interior of the container 10. The container 10 may further include a panel 20 (e.g., a door) configured to close the opening 18. According to some embodiments, the panel 20 may be formed of fabric and may be configured to roll-up, for example, similar to a roll-up window shade. The panel 20 may include one or more latches 22 configured to secure the panel 20 in a closed position within the opening 18.

The walls 16 of the container 12 may be formed from a variety and/or combination of materials. For example, one or more of the walls 15 may include aluminum (e.g., a sheet of aluminum) and/or various plastic or composite materials such as, for example, Lexan®, fiberglass, Kevlar®, polypropylene, and/or honeycomb panels. The use of other materials is contemplated. The floor 12 may be formed of, for example, aluminum, such as, for example, a relatively thick (e.g., a thickness ranging from about 0.160 inch to about 0.190 inch) sheet of aircraft aluminum and/or of aluminum sheets sandwiching another material, such as for example, a honeycomb material to provide stiffness and/or structural strength. The panel 20 of the container depicted in FIG. 2A may be formed of fabric (e.g., a high temperature-resistant fabric such as, for example, fiberglass cloth).

The interior of the container 10 may include a layer (e.g., a coating) of intumescent material. For example, interior surfaces of the floor 12, roof 14, walls 16, and/or panel(s) 20 may include a coating of intumescent material that at least partially covers the floor 12, roof 14, walls 16, and/or panel(s) 20. For example, as depicted in FIG. 1B, the roof 14 and/or walls 16 may include a layer of aluminum or Lexan® 24, and the interior surfaces of the roof 14 and/or the walls 16 may include a layer of intumescent material 26.

Figure 2B:
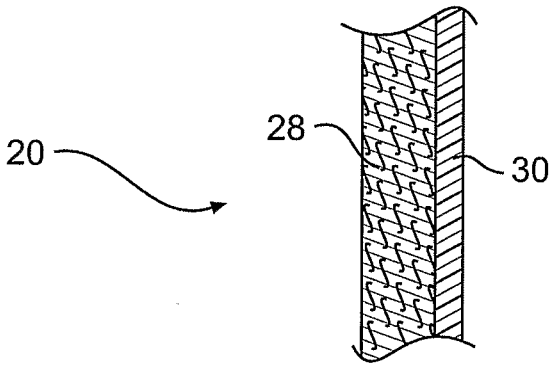
FIG. 2B is a schematic, partial cross-section view of a portion of the embodiment of FIG. 2A.

Referring to the exemplary embodiment of panel 20 depicted in FIG. 2B, the panel 20 may be configured to roll up and may include a fabric layer 28 and an intumescent layer 30. For example, the fabric layer 28 may include fiberglass cloth and the intumescent layer 30 may include an acrylic intumescent coating, which may have more flexibility than an epoxy intumescent layer. Although strands included in an untreated fiberglass cloth tend to separate when flexed in service and/or tend to be abrasive and wear and cut each other when flexed, application of an acrylic intumescent coating may overcome such problems. This may be a result of the strands being essentially encapsulated by the acrylic intumescent coating, for example, which may tend to prevent strand separation and may render the strands un-abrasive to one another.

Figure 3:
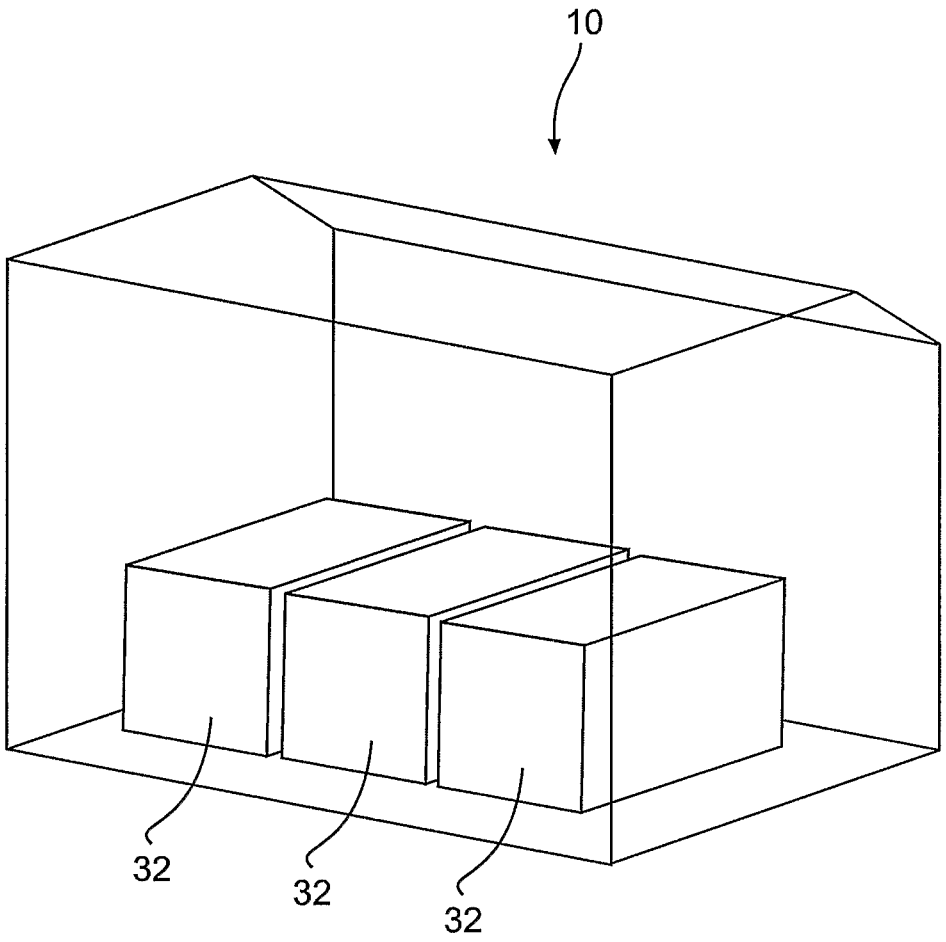
FIG. 3 is a schematic perspective view of an exemplary embodiment including a system of containers for containing and/or suppressing a fire.

According to some embodiments, a system of containers may include a container and one or more relatively smaller containers, for example, similar to the exemplary embodiment depicted in FIG. 3. Referring to FIG. 3, for example, a system of containers may include a container 10, which may contain a number of relatively smaller containers 32. The container 10 may be configured, for example, at least similarly to the exemplary embodiments depicted in FIGS. 1A and 2B. For example, the container 10 depicted in FIG. 3 may include an interior surface substantially covered with an intumescent material. One or more of the relatively smaller containers 32 may be configured to include interior surfaces that are at least partially (e.g., at least substantially) covered with an intumescent material. According to some embodiments, the container 10 may not include intumescent material, and one or more of the relatively smaller containers may include intumescent material. Such a system of containers may be used for the transport of objects prone to ignite relatively easily, such as, for example, Lithium batteries, which may be placed within the relatively smaller containers 32, which, in turn, may be placed in the container 10.

It will be apparent to those skilled in the art that various modifications and variations can be made to the structure and methodology described herein. Thus, it should be understood that the invention is not limited to the subject matter discussed in the specification. Rather, the present invention is intended to cover modifications and variations.

What is claimed is:

1. A container for containing and/or suppressing a fire inside the container, the container comprising:
- a floor;
- a roof;
- at least one wall associating the floor and the roof, the at least one wall defining an opening configured to provide access to the interior of the container; and
- at least one panel configured to close the opening,
- wherein at least one of the floor, the roof, the at least one wall, and the at least one panel comprise an intumescent material substantially covering an interior surface thereof, such that a fire inside the container is at least one of contained within the container and suppressed.

2. The container of claim 1, wherein the intumescent material substantially covers an interior surface of the roof, the at least one wall, and the at least one panel.

3. The container of claim 1, wherein the roof and the at least one wall comprise at least one material selected from aluminum, plastic material, composite material, polycarbonate sheet, fiberglass, para-aramid synthetic fiber, polypropylene, and honeycomb panel.

4. The container of claim 1, wherein the at least one panel comprises at least one material selected from metal and fiberglass.

5. The container of claim 1, wherein the intumescent material comprises at least one of an epoxy material and an acrylic material.

6. The container of claim 1, wherein the panel comprises fiberglass cloth and is configured to roll up.

7. The container of claim 6, wherein the intumescent material substantially covers an interior surface of the panel.

8. The container of claim 7, wherein the intumescent material comprises an acrylic material.

9. A system of containers for suppressing and/or containing a fire inside at least one of the containers, the system comprising:
- a container comprising
  - a floor,
  - a roof,
  - at least one wall associating the floor and the roof, the at least one wall defining an opening configured to provide access to the interior of the container, and
  - at least one panel configured to close the opening; and
- at least one relatively smaller container contained within the container,
  - wherein at least one of the container and the at least one relatively smaller container comprises an interior surface substantially covered with an intumescent material, such that a fire inside the container with the interior surface substantially covered with intumescent material is at least one of contained within the container and suppressed.

10. The system of claim 9, wherein at least one of the floor, the roof, the at least one wall, and the at least one panel comprise the intumescent material substantially covering an interior surface thereof.

11. The system of claim 9, wherein the at least one relatively smaller container comprises an interior surface substantially covered with the intumescent material.

12. The system of claim 9, wherein the container and the at least one relatively smaller container comprise interior surfaces substantially covered with the intumescent material.

13. A method for at least one of containing and suppressing a fire inside a container, the method comprising:
- providing a layer of intumescent material on at least one interior surface of the container, wherein the layer of intumescent material protects the interior of the container from fire inside the container.

14. The method of claim 13, wherein the container comprises a roof, at least one wall defining an opening, and at least one panel closing the opening, wherein the method comprises providing the layer of intumescent material on an interior surface of at least one of the roof, the at least one wall, and the at least one panel.

15. The method of claim 13, further comprising placing the container within a relatively larger container, the relatively larger container comprising an interior surface substantially covered with an intumescent material.

16. The container of claim 1, wherein the at least one wall is formed of a sheet of material partially defining the interior surface of the container, and wherein the interior surface is at least partially coated with the intumescent material, such that the intumescent material is exposed to the fire inside the container.

17. The system of containers of claim 9, wherein the at least one wall is formed of a sheet of material partially defining the interior surface of the container, and wherein the interior surface is at least partially coated with the intumescent material, such that the intumescent material is exposed to the fire inside the container.

18. The method of claim 13, wherein the container comprises a wall formed of a sheet of material partially defining the interior surface of the container, and wherein providing a layer of intumescent material on at least one interior surface of the container comprises at least partially coating the sheet of material with the intumescent material, such that the intumescent material is exposed to the fire inside the container.

* * * * *